US006443353B1

(12) United States Patent
Kleinschnittger et al.

(10) Patent No.: US 6,443,353 B1
(45) Date of Patent: Sep. 3, 2002

(54) FITTINGS AND PROCESS FOR PRODUCING FITTINGS FOR THE MECHANICAL PROCESSING OF AQUEOUS PAPER STOCK

(75) Inventors: Hans Herrmann Kleinschnittger, Weingarten; Josef Schneid, Vogt, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/577,589

(22) Filed: May 25, 2000

(30) Foreign Application Priority Data

May 25, 1999 (DE) ..... 199 23 865

(51) Int. Cl.[7] ..... B23K 31/00
(52) U.S. Cl. ..... 228/165; 228/122.1
(58) Field of Search ..... 228/165, 164, 228/122.1, 246, 248.1, 903, 124.5; 428/621

(56) References Cited

U.S. PATENT DOCUMENTS

| | | | | |
|---|---|---|---|---|
| 1,528,866 | A | * | 3/1925 | Youngchild et al. |
| 2,654,295 | A | | 10/1953 | Sutherland |
| 3,230,616 | A | * | 1/1966 | Janssen |
| 3,887,429 | A | | 6/1975 | Schmid et al. |
| 3,918,217 | A | * | 11/1975 | Oliver |
| 3,979,042 | A | * | 9/1976 | Peters |
| 4,586,662 | A | | 5/1986 | Goldenberg et al. |
| 4,608,321 | A | * | 8/1986 | Sato et al. |
| 4,625,926 | A | | 12/1986 | Kirchner |
| 4,813,621 | A | | 3/1989 | Kleinhans |
| 4,909,900 | A | | 3/1990 | Matzke et al. |
| 4,955,549 | A | | 9/1990 | Reinhall |
| 5,000,823 | A | | 3/1991 | Lindahl |
| 5,156,750 | A | | 10/1992 | Henricson et al. |
| 5,200,038 | A | | 4/1993 | Brown |
| 5,326,038 | A | | 7/1994 | Nilsson |
| 5,398,877 | A | | 3/1995 | Xiangzhi |
| 5,520,344 | A | | 5/1996 | Fey et al. |
| 5,522,553 | A | | 6/1996 | LeClair et al. |
| 5,538,343 | A | | 7/1996 | Tynan |
| 5,580,472 | A | | 12/1996 | Maybon |
| 5,779,168 | A | | 7/1998 | Meltzer |
| 5,836,525 | A | | 11/1998 | Garnier et al. |
| 5,836,531 | A | | 11/1998 | Maybon |
| 6,020,076 | A | * | 2/2000 | Fujii et al. |

FOREIGN PATENT DOCUMENTS

| | | |
|---|---|---|
| DE | 19603548 | 5/1997 |

OTHER PUBLICATIONS

Meltzer et al. Translation to DE 19603548. 5–97. pp. 1–13.*

* cited by examiner

*Primary Examiner*—Tom Dunn
*Assistant Examiner*—Jonathan Johnson
(74) *Attorney, Agent, or Firm*—Greenblum & Bernstein, P.L.C.

(57) ABSTRACT

A process for producing a fitting for the mechanical processing of aqueous fiber stock and a fitting made by the process. The fitting includes at least one base body and at least one processing element. The process includes producing at least one hard material body which forms at least a portion of the at least one processing element, and penetrating the at least one hard material body with a binder and permanently bonding the at least one hard material body and the binder.

62 Claims, 2 Drawing Sheets

FITTINGS AND PROCESS FOR PRODUCING FITTINGS FOR THE MECHANICAL PROCESSING OF AQUEOUS PAPER STOCK

CROSS-REFERENCE TO RELATED APPLICATIONS

The present application claims priority under 35 U.S.C. § 119 of German Patent Application No. 199 23 865.0, filed on May 25, 1999, the disclosure of which is expressly incorporated by reference herein in its entirety.

BACKGROUND OF THE INVENTION

1. Field of the Invention

The invention relates to a process for producing fittings for the mechanical processing, in particular the refining, of aqueous paper stock. The invention also relates to fittings made by the process.

2. Discussion of Background Information

Fittings (sometimes referred to as processing elements, processing tools, segments, refiner tooling, linings, disks, or fillings) of this type are primarily used for refining paper fibers, dispersing impurities in the paper stock, or fiberizing, i.e., breaking up, paper fiber agglomerates. They are used in refiners, fiberizers, or dispersers. Examples of these devices include U.S. Pat. No. 2,654,295 to Sutherland, U.S. Pat. No. 4,813,621 to Kleinhans, U.S. Pat. No. 5,200,038 to Brown, and U.S. Pat. No. 5,779,168 to Meltzer, the disclosures of each of these documents being herein incorporated by reference in their entireties.

Such machines typically have at least one rotor and at least one stator with either disk-shaped or cone-shaped surfaces to which the fittings are mounted so that a gap can form between them. Many fittings have bars and grooves on their working surfaces, so that they are also referred to as "sets of bars." Other fittings have the shape of toothed rings. Moreover, it is known that, in addition to the shape of such bars, grooves, and teeth, the material of which fittings consist also affects the processing of the stock. Additionally, the running wheels used inpulpers can also utilize fittings in the sense referred to herein, with which the wet reduction of the introduced stock material is carried out.

With the aid of such fittings, the paper fibers can be effectively mechanically processed in a pumpable suspension, i.e., with a solids content of about 2–8%, or as a tough, high-consistency substance.

However, as a result of their use in fiber processing, the fittings are constantly exposed to wear and must therefore be replaced at certain intervals. This wear often causes their processing effect to change during the life of the fittings, e.g., reducing their ability to process the fibers efficiently. Moreover, since their shape, and in particular the shape of their edges as well as the surface of the fittings strongly influence the processing effect, any wearing of these surfaces reduces their ability to efficiently process the fibers.

Considerable efforts are being made to develop fittings with varied shapes and material selections. It has become evident from these efforts that particularly suitable materials may be used for these processing elements. However, many of these materials have properties which can cause severe problems when the material is used in the base body of the fitting. Accordingly, materials which are very hard and brittle and thus do not have the necessary toughness are not particularly useful for the base body. Furthermore, such hard and brittle materials are relatively expensive and laborious to produce. Moreover, compared to commonly used metallic materials, these can only be worked at great expense.

The base body of a conventional processing tool provides the connection of the processing elements to the other components of the processing machine, e.g., those of a refiner. Owing to the high forces which typically occur in such a refiner, the strength requirements for the base body are particularly high. Additionally, it must be possible to fix the fittings, and in particular the base body of the fitting, firmly to the refiner. For this purpose, high-stress screws, for example, are typically required. However, because of such demands, a particularly strong and tough material is required.

From German Application No. DE 196 03 548 A1, which is expressly incorporated by reference in its entirety, discloses a known process for producing fittings in which the fittings are assembled from separately produced parts. This document discloses the use of a very expensive high-temperature soldering process under vacuum and/or an adhesive process. However, these processes, while suitable per se, cannot always be used because they are too expensive for many applications. Moreover, when less expensive processes are selected, they do not always produce fittings having adequate strengths.

SUMMARY OF THE INVENTION

The invention is directed to a process for producing fittings so that production is simplified and which is particularly suitable such that hard materials can be used for the processing elements. The invention is also directed to fittings made by the process.

With the aid of the process, it is possible to produce the desired shapes of the processing elements relatively simply. It can be particularly advantageous for the hard material body, which can often be worked easily, to be pre-made or pre-formed in the desired shape. Accordingly, this shape should essentially correspond to the processing element which will be manufactured later. Thus, by utilizing a solidification process, in particular a curing after penetration with a binder, the processing element can receive the properties needed for its use. Accordingly, the labor-intensive working or processing of hard-structures can be omitted. In certain embodiments of the invention, for example, the hard material body can contain a hard metal powder or can be made from compacted hard metal powder. Moreover, it can also be provided with a polymer matrix which readily melts away or evaporates during processing so as to leave cavities which can be penetration with a binder.

A solder, such as a nickel based solder, can be advantageously selected as the binder for carrying out the process. This binder can be applied in a bonding composition as a paste or can be laid on the surface in the form of a foil or foils, and/or masks. Additionally, both the hard material body and the binder can be present as foils or plates, such that they can advantageously be worked together, e.g., they can be cut together into the desired outline shape. The penetration and bonding which occurs with the hard material body takes place at appropriately high temperatures. Accordingly, it is advisable for the hard metal body as well as the base body to be heated to the required soldering temperature. Alternatively, at least at the bonding contact surfaces and/or the upper surface of the hard material body can be so heated.

In this manner, a processing element can be formed having a homogeneous structure, in which as a rule, cavities, e.g., surface cavities, are eliminated. In order to improve bonding between the hard material body and the base body, it is advisable to apply binder also at the contact surfaces of the two bodies which are to be joined. Since, as a rule, the processing elements are provided with grooves (e.g., channels between refiner knives or bars), it may be advisable to take measures in order to prevent the permanent filling these grooves with the binder. This may be accomplished by applying an agent to the grooves which prevents them from being wetted with the binder. Alternatively, the grooves can be filled with temporary bodies or structures which prevent the binder from entering the grooves. Accordingly, these bodies would later be removed to expose the binder free grooves. Of course, any conventional agent may be utilized for this purpose. Moreover, other masking and/or anti-wetting techniques may also be used.

Under certain circumstances, it may also be advisable to construct the processing element in several layers. For example, this can occur by successively processing and/or stacking several hard material bodies of the same shape in layers. Thus, in a first working step, a hard material body could be brought into contact with the base body and be penetrated with the binder so that a firm bond is formed with the base body. Thereafter, a required number of further hard material bodies could be laid on top and bonded with the part lying beneath it so as to produce a layered structure. However, the hard material bodies and layers of binder can also be layered as a sandwich structure so as to be processed in a single procedure.

As is generally known in production processes of this type, different materials can be effectively joined in this manner. Accordingly, this process can be used to produce fittings wherein the material of the bars or hard material bodies can be different from those used for the base body. This, then has the considerable advantage of allowing for the selection of materials used for the processing elements to be matched to the desired processing technology. Additionally, this also allows for the material of the base body to be primarily optimized with regard to its strength and cost.

It is particularly to useful to produce the lower part of the processing elements from a different material, in particular that of the base body. Then, the upper parts, which are typically more highly stressed, can be made extremely wear-resistant. At the same time, the lower parts, which serve only to keep the channels open for transporting the suspended refining material and which made up the greater mass of the fittings, can be made of a less wear resistant material. Thus, the fitting can be produced in a particularly cost-effective manner since expensive highly wear resistant materials are used only where needed while less expensive materials are utilized in areas where wear resistance is less important.

Thus the invention provides for a process for producing fittings for the mechanical processing, in particular the refining, of aqueous paper stock, which fittings are composed of at least one base body and at least one processing element with which the paper stock material is in contact when the fitting is in operation, characterized in that first a hard material body is produced whose shape essentially corresponds to at least a part of the processing element to be produced and that the hard material body is penetrated with a binder that then enters into a permanent bond in the hard material body. The hard material body may also be bonded with the base body during penetration. Moreover, before penetration, the hard material body may be brought into contact with the base body.

The processing element and the base body can also be produced from different materials. The hard material body and binder can be bonded at a temperature of at least approximately 600° C. Additionally, the hard material body and binder can be bonded at a temperature of at least approximately 1000° C. The processing element may be provided with grooves extending to the base body.

Further, a metallic solder may be used as the binder. The binder may be applied onto the hard material body as a layer before penetration. The layer may be produced with the same outline shape as the hard material body. Moreover, the outline shape of the hard material body and the binder layer may be produced in a joint operation before penetration. The layer may also be applied at points at which the hard material body has grooves. Additionally, the grooves may be prepared so that no bonding takes place therein between the binder and the base body.

The hard material body may be formed from powdered metal. Accordingly, the hard material body may be produced from hard material grains having a grain size of 3 to 100 micrometers. The hard material body may also be produced from grains that have an angular shape. The hard material body may further be produced from grains whose shape is rounded off on all sides. Moreover, the hard material body may be produced using hard metal grains. The hard metal grains may consist essentially of tungsten carbide. Additionally, the hard material body may be produced using silicon carbide. The hard material body may also be produced in a composite of a more readily melting matrix and hard material grains and that the matrix is removed before or during penetration and thus the cavities are freed for the binder. The hard material body may be produced as a porous packing. The grain aggregate may be compacted and consolidated by compression.

The geometric shape of the finished processing element can essentially correspond to that of the hard material body.

The fitting may also be produced in several working steps, with the height of the fitting, proceeding vertically from the base body, being increased in stages, in that several hard material bodies are used for the same part of the processing element. Several hard material bodies may be in contact with one another and be bonded together in one operation by penetration with binder.

The processing element may be constructed so that strip-shaped elevations are formed on a base body, extending perpendicular to it, and that grooves are situated between them. The processing element may be constructed so that tooth-shaped elevations are formed on a base body, extending perpendicular to it. A part already provided with elevations may be used as the base body, whereby the elevations have the same outline shape as that of the processing element to be produced.

The invention also contemplates that a previously used fitting which has been worn down by use may be used as the base body.

According to one aspect of the invention, there is provided a process for producing a fitting for the mechanical processing of aqueous fiber stock, wherein the fitting comprises at least one base body and at least one processing element, the process comprising producing at least one hard material body which forms at least a portion of the at least one processing element, and penetrating the at least one hard material body with a binder and permanently bonding the at least one hard material body and the binder. The penetrating of the binder may bond the at least one hard material body to the at least one base body. The at least one hard material body may have a shape which essentially corresponds to at least a part of the processing element. The fitting may be adapted for refining an aqueous paper stock. The at least one hard material body may have a base body attachment portion and at least one stock processing portion. Prior to the penetrating, the process may further comprise bringing the at least one hard material body into contact with the at least one base body. The at least one hard material body and the at least one base body may be made from different materials. The permanent bonding may further include bonding the binder and the at least one hard material body at a temperature of at least approximately 600° C. The permanent bonding may further include bonding the binder and the at least one hard material body at a temperature of at least approximately 1000° C. The permanent bonding may further include bonding the binder and the at least one hard material body at a temperature of approximately 1120° C.

The at least one hard material body may comprise a plurality of hard material bodies. The plurality of hard material bodies may be arranged to form grooves. The at least one base body may comprise grooves and the plurality of hard material bodies are arranged on ungrooved portions of the least one base body. The binder may comprise a metallic solder. The metallic solder may comprise at least one of a nickel based solder and a copper alloy containing solder. The metallic solder may comprise a paste. The paste comprises a powder which includes at least one of nickel and copper.

Prior to the penetrating of the binder, the binder may be applied to the at least one hard material body as a layer. The layer may comprise an outline shape which is substantially similar to an outline shape of the at least one hard material body. Prior to the penetrating of the binder, the outline shape of each of the hard material body and the binder layer may be produced in a joint operation. The layer may be applied at points at which the hard material body is adjacent a groove. The at least one hard material body may comprise a plurality of hard material bodies which are arranged to form grooves, and the process further comprises applying the binder to the plurality of hard material bodies.

The process may further comprise preparing the at least one groove in order to prevent bonding between the binder and the at least one groove. The preparing may comprise one of placing an anti-wetting agent within the at least one groove and placing a structure within the at least one groove. The process may further comprise removing one of the anti-wetting agent and the structure from the at least one groove. The at least one hard material body may be produced from powdered metal. The powdered metal may comprise hard material grains having a grain size in the range of approximately 3 to approximately 100 micrometers. The powdered metal may comprise material grains having an angular shape. The powdered metal may comprise material grains having a rounded off shape. The powdered metal may comprise hard metal grains. The hard metal grains comprise tungsten carbide. The hard metal grains may comprise essentially tungsten carbide. The hard metal grains may comprise silicon carbide. The at least one hard material body may comprise a composite of a more readily melting matrix and hard material grains. The matrix may be removed in one of before and during penetration of the binder into one of the at least one hard material body and the at least one base body, whereby cavities are freed for the binder.

The at least one hard material body may comprise a porous packing. A grain aggregate of the porous packing may be compacted and consolidated by compression. A geometric shape of the porous packing after compression may substantially correspond to that of the at least one hard material body. The process may further comprise producing at least one additional hard material body, and increasing a height of at least a portion of the processing element by placing the at least one additional hard material body on the at least one hard material body. The process may further comprise applying a binder to one of the at least one hard material body, the at least one additional hard material body, and the at least one base body, and attaching the at least one additional hard material body to the at least one hard material body.

The fitting may comprise several hard material bodies which are bonded together in one operation by penetration with the binder. The at least one hard material body may comprise a plurality of hard material bodies which extend substantially perpendicularly from the at least one base body to form strip shaped elevations with grooves formed between the strip shaped elevations. The at least one hard material body may comprise a tooth-shaped elevation. The base body may comprise a used fitting. The used fitting may comprise partial elevations integrally formed thereon. The at least one hard material body may comprise a shape which is substantially similar to a shape of the integrally formed elevations. The used fitting may be mechanically prepared prior to having the at least one hard material body attached thereto.

The invention also provides for a fitting made by a process which includes producing at least one hard material body which forms at least a portion of the at least one processing element, and penetrating the at least one hard material body with a binder and permanently bonding the at least one hard material body and the binder.

The invention further provides for a process for producing a fitting for the mechanical processing of aqueous fiber stock, wherein the fitting comprises a base body and a plurality of hard material bodies, the process including forming each of the plurality of hard material bodies, each hard material body having at least one attachment surface and at least one other surface, applying a binder to one of the at least one attachment surface, the at least one other surface, and the at least one base body, and attaching the at least one hard material body to the base body. The binder may be applied between the at least one attachment surface and the base body. The binder may be applied to the at least one other surface. The binder may be applied between the at least one attachment surface and the base body and to the at least one other surface. The attaching may comprise heating at least one of the base body, the binder, and the at least one hard material body. The attaching may comprise a permanent bond. The attaching may comprise allowing the binder to penetrate each of the plurality of hard material bodies. The fitting may be used for refining an aqueous paper stock. The base body may comprise an attachment surface which supports a binder layer.

The process may further comprise allowing the binder to penetrate into each of the plurality hard material bodies and allowing the binder to attach each of the plurality of hard material bodies to the base body. The attaching of the plurality of hard material bodies may occur during a penetration of the binder. The plurality of hard material bodies may be spaced apart from one another so as to define at least one groove therebetween. The binder may comprise a metallic solder. The metallic solder may comprise one of a nickel based solder and a copper alloy containing solder. A fitting made by the process including forming each of the plurality of hard material bodies, each hard material body having at least one attachment surface and at least one other surface, applying a binder to one of the at least one attachment surface, the at least one other surface, and the at least one base body, and attaching the at least one hard material body to the base body.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
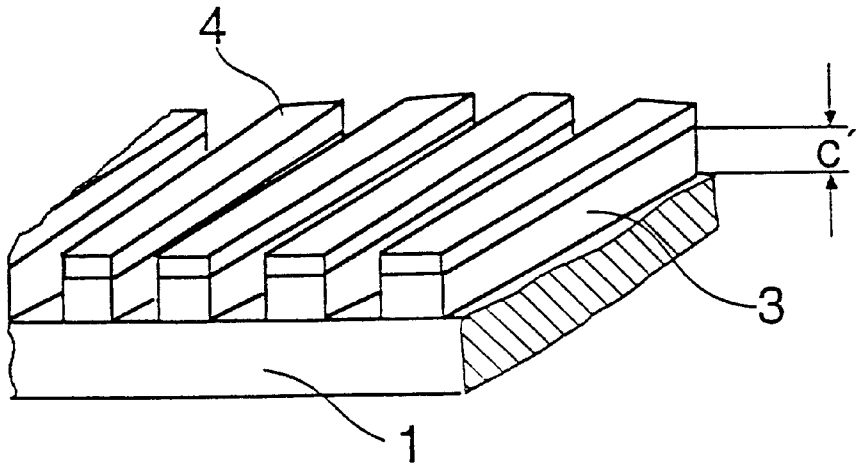
FIGS. 1*a* and 1*b* show two process states using a set of bars as an example.
Figure 1B:
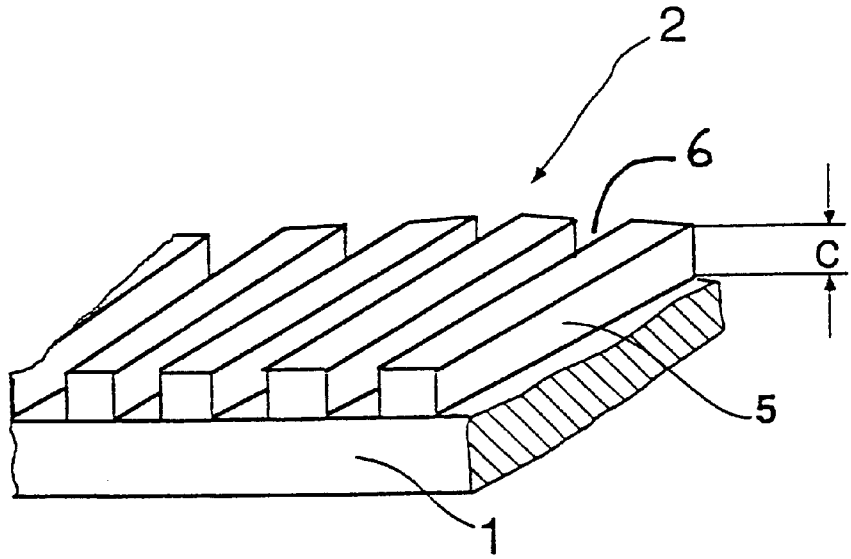

FIG. 1*a* shows the part of a refiner fitting produced according to the invention. Fitting has a plate-shaped base body 1, on which is positioned a hard material body 3, and more specifically a number of hard material bodies in the form of strips. Above hard material body 3 is disposed a binder 4 which has not yet been melted. Binder 4 is preferably in the form of a layer whose outline largely corresponds to the outline of hard material body 3. Accordingly, in FIG. 1*b*, binder 4 is shown having already penetrated hard material body 3 so as to produce or form very strong, stripshaped elevations 5. Further, as is clearly seen from the figure, elevations 5 have a shape which essentially corresponds to the hard material body 3. Located between elevations 5 are spaces in the form of grooves 6.

In this manner, a fitting or processing element 2 is formed or manufactured according to the invention which can be used for refining suspended paper fibers.

The bar height C is preferably between approximately 3 and approximately 8 mm when new. Moreover, this height can essentially correspond to hard material body height C' of FIG. 1*a* after binder 4 penetrates hard material body 3. However, certain changes in shape of elevations 5 can also ensue during penetration with binder 4. Additionally, sets of bars can also be formed having different designs than shown here, e.g., they need not be straight as is shown, but can have a variety of shapes such as curved. Further, the bar width, bar height, bar shape, and bar angle can all be varied for the particular fiber processing needs. The advantage of the process of the invention is precisely that the adjustment to the required geometric relationships can be made very simply during the production of the fittings.

Figure 2:
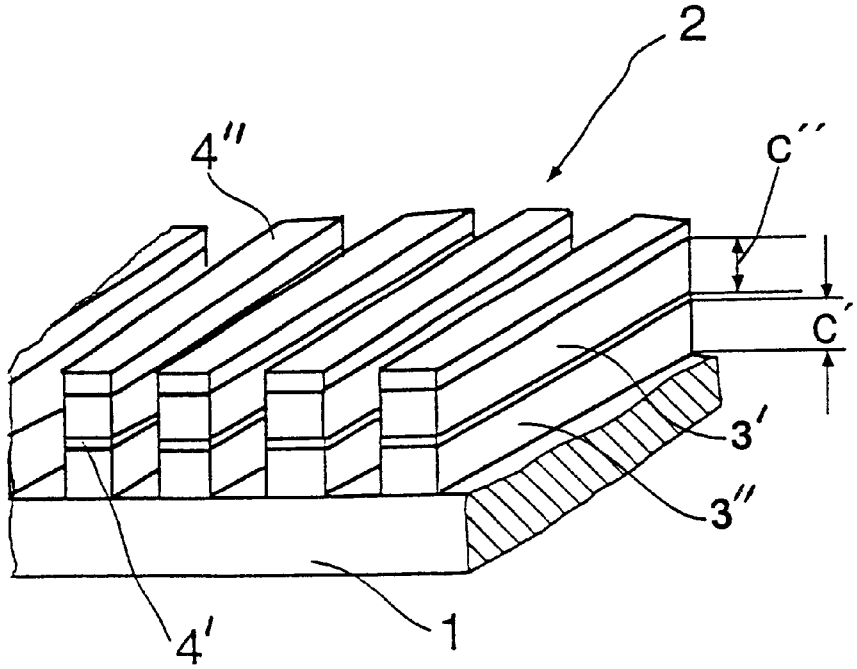
FIG. 2 shows a multi-layer arrangement (before penetration)

As already mentioned, several hard material bodies 3", 3' can also be positioned on top of one another in order to be able to produce greater bar heights in this manner. Such an embodiment is shown in FIG. 2, which indicates this process in principle. Here, a binder interlayer 4' is used between two hard material bodies 3" and 3' which are positioned on top of one another. Binder interlayer 4' acts to join hard material body 3' to hard material body 3". Of course, it should be noted that hard material body height C' and/or C" can also be varied. Moreover, additional layers of binder 4' and hard material body 3' can also be added so as to form as many layers as desired.

Further, one or more layers may be used and/or added to recondition a worn fitting. In this regard, a worn fitting may have an initial appearance similar to that of FIG. 1*b*, such that after reconditioning, it would look similar to that of FIG. 2. Of course, the process according to the invention contemplates that such worn fittings be properly prepared to receive the refurbishing layers. Accordingly, the receiving surfaces of hard material body 5 may be initially subjected to machining, grinding, or otherwise prepared and/or cleaned so as to receive one or more successive layers of binder and hard material body.

Figure 3:
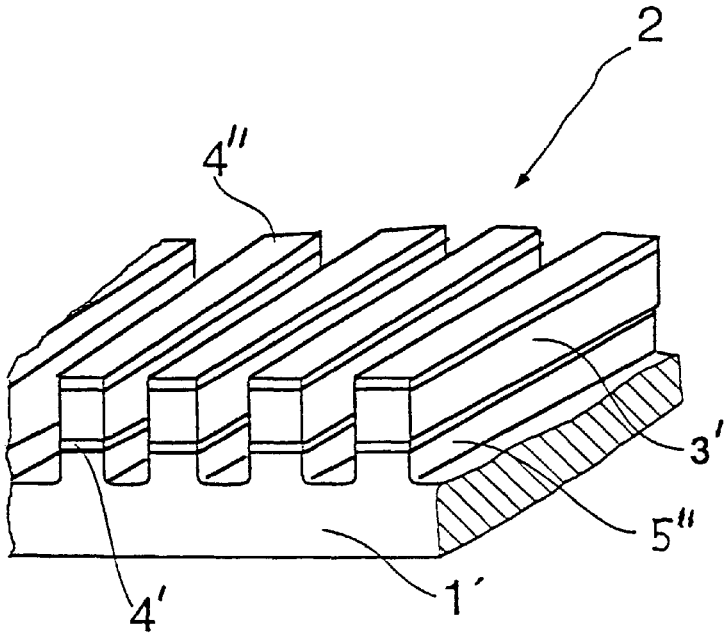
FIG. 3 shows a cost-effective variant.

FIG. 3 shows a particularly economical variant of the production process. Here, a base body 1' already contains elevations or partial elevations 5", e.g., integrally formed with base body 1'. Moreover, the shape and arrangement of elevations 5" should essentially correspond to the outline of hard material bodies 3'.

Further, the use of such sets of bars for the refining of fibers is, as a general rule, only possible when channels or grooves 6 having a certain minimum height exist between the bars or knives. Accordingly, the wearing away of the entire bars during refining is therefore to be avoided.

The invention therefore provides that the material does not need to be particularly wear-resistant in this lower region of the bars. On the contrary, it is sufficiently advantageous when this material is instead tough, i.e., as tough as base body 1'. Accordingly, this will often be the case when elevations 5" and base body 1' are integrally formed from a single material.

Figure 4:
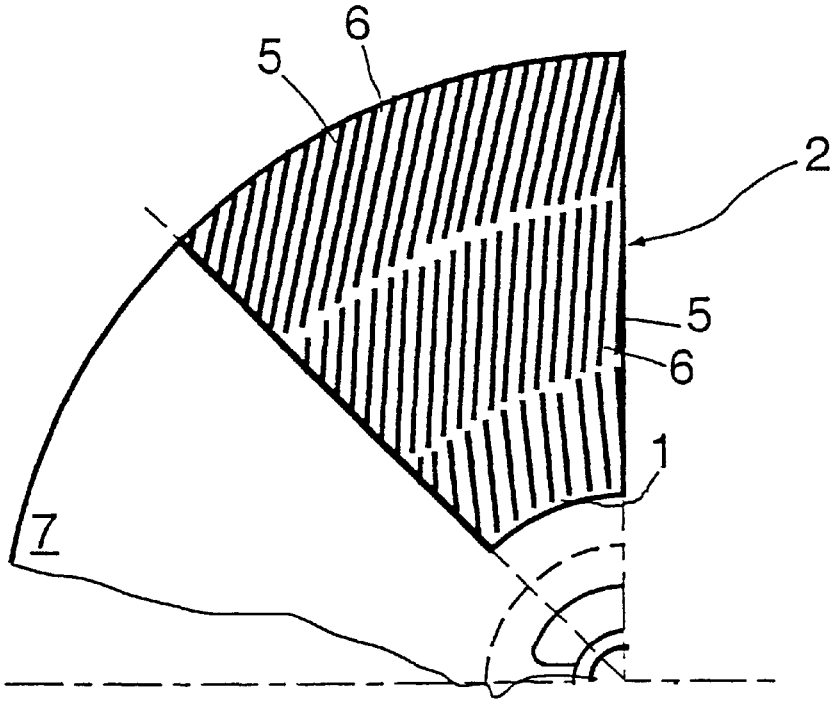
FIG. 4 shows a view of a set of bars for paper stock refining.

FIG. 4 shows an example of a refiner fitting in top view. The processing elements 2 are visible in the form of a number of elevations 5 and include intervening grooves 6 lying between them. Accordingly, elevations 5 have already been joined to the base body 1. Moreover, fittings are shown in the usual manner, e.g., produced as ring segments which are combined to form ring surfaces on a fitting support 7.

Results have been achieved using a chrome steel with the material No. 1.4404/WOC as the material for base body 1. Of course, other suitable materials may also be utilized. Additionally, hard metal body 3, 3', 3" may be, e.g., approximately a 3 mm thick layer, formed by Wolfram-carbide grains, i.e., powdered metal. In this regard, the Wolfram-carbide percentage can be greater than approximately 70% and the grain size may be, at least predominately, in the range of approximately 60 to approximately 70$\mu$. Further, the intermediate spaces of the powered metal may be filled with a polymer which is thermally removed during penetration.

Moreover, a paste can be used as binder 4 and 4'. Additionally, this paste can be applied to hard metal bodies 3, 3' and 3", as well as between hard material bodies 3' and 3", and/or between hard material bodies 3' and 5", between hard material body 3, 3" and base body 1, 1', and between hard material body 3' and elevation 5". (see FIGS. 1–3). Further, the material for binder 4, 4' may preferably include a nickel basis solder, which may be in the form of a powder, and a copper alloy in the form of a powder which contains nickel.

Preferably, the penetration of binder 4, 4' into hard metal body 3, 3', 3" and/or base body 1, 1', 5" occurs at approximately 1120° C. However, the invention contemplates the use of other binders, base body, and hard material body materials in which different temperatures may be required to effectively cause penetration and/or joining.

Thus, the invention provides for a process for producing fittings for the mechanical processing, in particular the refining, of aqueous paper stock, which fittings are composed of at least one base body 1, 1' and at least one processing element 2 with which the paper stock material is in contact when the fitting is in operation. The fitting includes one or more hard material bodies 3, 3', 3" which are produced having a shape which essentially corresponds to at least a part of the processing element to be produced and that hard material body 3, 3', 3" is penetrated with a binder 4 that then enters into a permanent bond in hard material body 3, 3', 3".

Hard material body 3, 3'; 3" may also be bonded with base body 1, 1' during penetration. Moreover, before penetration, it is also possible that hard material body 3, 3" may be brought into contact with base body 1, 1'.

Processing element 2, and in particular the bars, and base body 1, 1' can also be produced from different materials. Additionally, hard material body 3, 3', 5' and binder 4, 4' can be bonded at a temperature of at least approximately 600° C. Additionally, the boding can occur at a temperature of at least approximately 1000° C. Further, the bonding can occur at a temperature of approximately 1120° C. Preferably, processing element 2 has a plurality of grooves 6 extending to the base body, see e.g., FIG. 3.

Further, a metallic solder such as a nickel based solder is preferably used as binder 4, 4'. Binder 4, 4' may be applied onto hard material body 3, 3', 3" as a layer before penetration. Additionally, the layer-may be produced with the same outline shape as hard material body 3, 3', 3". Moreover, the outline shape of hard material body 3, 3', 3" and binder layer 4, 4' may be produced in a joint operation before penetration. The layer may also be applied at points at which processing element 2 has grooves 6. Additionally, grooves 6 may be prepared so that no bonding takes place therein between binder 4, 4' and base body 1, 1'.

Further, hard material body 3, 3', 3" may be produced from powdered metal having hard material grains with a grain size of approximately 3 to 100 micrometers. Hard material bodies 3, 3', 3" may also be produced from grains that have an angular shape or like configurations. Hard material bodies 3, 3', 3" may further be produced from grains whose shape is rounded off on all sides and/or symmetrical shaped.

Moreover, hard material bodies 3, 3', 3" may be produced using hard metal grains, which include, e.g., tungsten carbide. Additionally, hard material bodies 3, 3', 3" may be produced using, e.g., silicon carbide. Of course, other hard and durable material may also be utilized. Hard material bodies 3, 3', 3" may also be produced as a composite of a more readily melting matrix and hard material grains such that the matrix is removed either before or during penetration and thus the cavities are freed for binder 4, 4'. Additionally, hard material bodies 3, 3', 3" may be produced as a porous packing. Further, the grain aggregate may be compacted and consolidated by compression.

The geometric shape of the finished processing element 2 can essentially correspond to that of hard material body.

The fitting may also be produced in several working steps,.with the height of the fitting, proceeding vertically from base body 1, 1', being increased in stages, whereby several hard material bodies 3', 3" and even more, are used for the same part of processing element 2. Several hard material bodies 3', 3" may be in contact with one another and be bonded together in one operation by penetration with binder 4'.

Processing element 2 may be constructed so that strip-shaped elevations 3, 3", 5, 5" are formed on a base body, extending perpendicular to it, and that grooves 6 are situated between them. Processing element 2 may be constructed so that tooth-shaped elevations are formed on base body 1, 1', extending perpendicular to it. Moreover, as demonstrated by FIG. 3, a part already provided with elevations 5" may be used as base body 1', whereby elevations 3' have the same outline shape as that of the processing element 2 to be produced.

The invention also contemplates that a previously used fitting which has been worn down by use may be used as base body 1'.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for producing a fitting for the mechanical processing of aqueous fiber stock, wherein the fitting comprises at least one base body and at least one processing element, the process comprising:

producing at least one hard material body which forms at least a portion of the at least one processing element, the at least one hard material body comprising at least one of a porous packing and a powdered metal;

penetrating the at least one hard material body with a binder; and permanently bonding the at least one hard material body and the binder.

2. The process of claim 1, wherein the penetrating of the binder bonds the at least one hard material body to the at least one base body.

3. The process of claim 1, wherein the at least one hard material body has a shape which essentially corresponds to at least a part of the processing element.

4. The process of claim 1, wherein the fitting is adapted for refining an aqueous paper stock.

5. The process of claim 1, wherein the at least one hard material body has a base body attachment portion and at least one s stock processing portion.

6. The process of claim 1, wherein prior to the penetrating of the binder, the process further comprises bringing the at least one hard material body into contact with the at least one base body.

7. The process of claim 1, wherein the at least one hard material body and the at least one base body are made from different materials.

8. The process of claim 1, wherein the permanent bonding further includes bonding the binder and the at least one hard material body at a temperature of at least approximately 600° C.

9. The process of claim 8, wherein the permanent bonding further includes bonding the binder and the at least one hard material body at a temperature of at least approximately 1000° C.

10. The process of claim 9, wherein the permanent bonding further includes bonding the binder and the at least one hard material body at a temperature of approximately 1120° C.

11. The process of claim 1, wherein the at least one hard material body comprises a plurality of hard material bodies.

12. The process of claim 11, wherein the plurality of hard material bodies are arranged to form grooves.

13. The process of claim 11, wherein the at least one base body comprises grooves and the plurality of hard material bodies are arranged on ungrooved portions of the least one base body.

14. The process of claim 1, wherein the binder comprises a metallic solder.

15. The process of claim 14, wherein the metallic solder comprises at least one of a nickel based solder and a copper alloy containing solder.

16. The process of claim 14, wherein the metallic solder comprises a paste.

17. The process of claim 16, wherein the paste comprises a powder which includes at least one of nickel and copper.

18. The process of claim 1, wherein prior to the penetrating of the binder, the binder is applied to the at least one hard material body as a layer.

19. The process of claim 18, wherein the layer comprises an outline shape which is substantially similar to an outline shape of the at least one hard material body.

20. The process of claim 19, wherein prior to the penetrating of the binder, the outline shape of each of the hard material body and the binder layer is produced in a joint operation.

21. The process of claim 18, wherein the layer is applied at points at which the hard material body is adjacent a groove.

22. The process of claim 1, wherein the at least one hard material body comprises a plurality of hard material bodies which are arranged to form grooves, and the process further comprises applying the binder to the plurality of hard material bodies.

23. The process of claim 22, further comprising preparing the at least one groove in order to prevent bonding between the binder and the at least one groove.

24. The process of claim 23, wherein the preparing comprises one of placing an anti-wetting agent within the at least one groove and placing a structure within the at least one groove.

25. The process of claim 24, further comprising removing one of the anti-wetting agent and the structure from the at least one groove.

26. The process of claim 1, wherein the at least one hard material body is produced from hard material grains.

27. The process of claim 26, wherein the hard material grains have a grain size in the range of approximately 3 to approximately 100 micrometers.

28. The process of claim 26, wherein the hard material grains comprises material grains having an angular shape.

29. The process of claim 26, wherein the hard material grains comprises material grains having a rounded off shape.

30. The process of claim 26, wherein the hard material grains comprises hard metal grains.

31. The process of claim 30, wherein the hard metal grains comprise tungsten carbide.

32. The process of claim 31, wherein the hard metal grains comprise essentially tungsten carbide.

33. The process of claim 30, wherein the hard metal grains comprise silicon carbide.

34. The process of claim 1, wherein at least one hard material body comprises a composite of a more readily melting matrix and hard material grains.

35. The process of claim 34, wherein the matrix is removed in one of before and during penetration of the binder into one of the at least one hard material body and the at least one base body, whereby cavities are freed for the binder.

36. The process of claims 1, wherein the at least one hard material body comprises a porous packing formed of hard material grains.

37. The process of claim 36, wherein a grain aggregate of the porous packing is compacted and consolidated by compression.

38. The process of claim 36, wherein a geometric shape of the porous packing after compression substantially corresponds to that of the at least one hard material body.

39. The process of claim 1, further comprising;

producing at least one additional hard material body;

increasing a height of at least a portion of the processing element by placing the at least one additional hard material body on the at least one hard material body.

40. The process of claim 39, further comprising:

applying a binder to one of the at least one hard material body, the at least one additional hard material body, and the at least one base body; and attaching the at least one additional hard material body to the at least one hard material body.

41. The process of claim 40, wherein the fitting comprises several hard material bodies which are bonded together in one operation by penetration with the binder.

42. The process of claim 1, wherein the at least one hard material body comprises a plurality of hard material bodies which extend substantially perpendicularly from the at least one base body to form strip shaped elevations with grooves formed between the strip shaped elevations.

43. The process of claim 1, wherein the at least one hard material body comprises a tooth-shaped elevation.

44. The process of claim 1, wherein the base body comprises a used fitting.

45. The process of claim 44, wherein the used fitting comprises partial elevations integrally formed thereon.

46. The process of claim 45, wherein the at least one hard material body comprises a shape which is substantially similar to a shape of the integrally formed elevations.

47. The process of claim 46, wherein the used fitting is mechanically prepared prior to having the at least one hard material body attached thereto.

48. A process for producing a fitting for the mechanical processing of aqueous fiber stock, wherein the fitting comprises a base body and a plurality of hard material bodies, the process comprising:

forming each of the plurality of hard material bodies, each hard material body having at least one attachment surface and at least one other surface, each of the at least one hard material bodies comprising at least one of a porous packing and a powdered metal;

applying a binder to at least one of the at least one attachment surface, the at least one other surface, and the at least one base body; and attaching the at least one hard material body to the base body.

49. The process of claim 48, wherein the binder is applied between the at least one attachment surface and the base body.

50. The process of claim 48, wherein the binder is applied,to the at least one other surface.

51. The process of claim 48, wherein the binder is applied between the at least one attachment surface and the base body and to the at least one other surface.

52. The process of claim 48, wherein the attaching comprises heating at least one of the base body, the binder, and the at least one hard material body.

53. The process of claim 48, wherein the attaching comprises a permanent bond.

54. The process of claim 48, wherein the attaching comprises allowing the binder to penetrate each of the plurality of hard material bodies.

55. The process of claim 48, wherein the fitting is used for refining an aqueous paper stock.

56. The process of claim 48, wherein the base body comprises an attachment surface which supports a binder layer.

57. The process of claim 48, further comprising allowing the binder to penetrate into each of the plurality hard material bodies and allowing the binder to attach each of the plurality of hard material bodies to the base body.

58. The process of claim 57, wherein the attaching of the plurality of hard material bodies occurs during a penetration of the binder.

59. The process of claim 48, wherein the plurality of hard material bodies are spaced apart from one another so as to define at least one groove therebetween.

60. The process of claim 48, wherein the binder comprises a metallic solder.

61. The process of claim 60, wherein the metallic solder comprises one of a nickel based solder and a copper alloy containing solder.

62. A process for producing a fitting for the mechanical processing of aqueous fiber stock, wherein the fitting comprises at least one base body and at least one processing element, the process comprising:

producing at least one hard material body which forms at least a portion of the at least one processing element, the at least one hard material body being formed of hard material grains;

penetrating the at least one hard material body with a binder;

solidifying the at least one hard material body after the penetrating; and bonding the at least one hard material body to the at least one base body with the binder.

* * * * *